United States Patent [19]

Brandis et al.

[11] Patent Number: 4,464,335

[45] Date of Patent: Aug. 7, 1984

[54] NICKEL/IRON CASTING ALLOY EXHIBITING HIGH STRENGTH AT ELEVATED TEMPERATURES AND HIGH MICROSTRUCTURAL STABILITY

[76] Inventors: Helmut Brandis, Forstwaldstr. 694, 4150 Krefeld; Wolfgang Spyra, Bloemersheimstr. 12,, 4150 Krefeld; Josef Reismann, Köln-Berlinerstr. 94, 4600 Dortmund, all of Fed. Rep. of Germany

[21] Appl. No.: 470,456

[22] Filed: Feb. 28, 1983

[30] Foreign Application Priority Data

Feb. 27, 1982 [DE] Fed. Rep. of Germany ..... 3207162

[51] Int. Cl.[3] ..... C22C 28/00

[52] U.S. Cl. ..... 420/584; 420/588; 148/442; 376/900

[58] Field of Search ..... 420/584, 585, 588; 148/442; 376/900

[56] References Cited

U.S. PATENT DOCUMENTS 4,183,774 1/1980 Balleret ..... 420/584

OTHER PUBLICATIONS

Stahlschliissel, 1D Auflage 1974.

*Primary Examiner*—L. Dewayne Rutledge
*Assistant Examiner*—Debbie Yee
*Attorney, Agent, or Firm*—Cushman, Darby & Cushman

[57] ABSTRACT

The invention relates to a nickel/iron casting alloy, containing no cobalt, exhibiting high strength at elevated temperatures accompanied by insensitivity to thermal fatigue, and possessing microstructural constituents which are thermodynamically highly stable. The alloy exhibits high hardness at elevated temperatures, outstanding resistance to oxidation, corrosion and wear, as well as good welding properties. The alloy is particularly suitable as a material for nuclear reactor components, and is composed of 1.1 to 1.6% of carbon
0.5 to 1.5% of silicon
0.01 to 0.2% of manganese
22 to 26% of chromium
12.5 to 14.5% of molybdenum
0.2 to 0.8% of niobium (columbium)
35 to 40% of nickel
less than 0.01% of boron
less than 0.002% of tantalum and
18 to 26% of iron, to make up 100%.

9 Claims, 8 Drawing Figures

1000 : 1

1000 : 1

NICKEL/IRON CASTING ALLOY EXHIBITING HIGH STRENGTH AT ELEVATED TEMPERATURES AND HIGH MICROSTRUCTURAL STABILITY

The invention relates to a nickle/iron casting alloy, containing no cobalt, exhibiting high strength at elevated temperatures accompanied by insensitivity to thermal fatigue, possessing microstructural constituents which are thermodynamically highly stable, and exhibiting, in addition, high hardness at elevated temperatures, outstanding resistance to oxidation, corrosion and wear, as well as good welding properties, this alloy being particularly suitable as a material for nuclear reactor components.

Alloys which are capable of being used, for example, in the flange region of nuclear reactors are subject to the following requirements in respect of the limits to which certain accompanying elements may be present, namely that the cobalt, boron and tantalum contents should not exceed 0.1%, 0.01% and 0.002% respectively.

Iron-based alloys can, as a rule, be used only to a limited extent, on account of their low strength at elevated temperatures, and because of their poor corrosion resistance.

Nickel/chromium/boron/silicon alloys cannot be considered, on account of their inadequate toughness and corrosion resistance, so that it is impossible to exploit their advantages, such as a low melting-temperature range.

German Pat. No. 2,714,674 discloses a nickel-based alloy which is suitable for nuclear reactor components and possesses high hardness at both high and low temperatures, good corrosion resistance and good frictional properties, as well as good weldability and high fatigue strength, this alloy containing 0.2 to 1.9% of carbon, 18 to 32% of chromium, 1.5 to 8% of tungsten, 6 to 12% of molybdenum, and optional additions of up to 2% each of silicon, up to 3% each of, in each case, manganese, niobium/tantalum, zirconium, vanadium, and up to 0.9% of boron, the remainder, 15 to 40% being nickel.

The object of the invention is to propose a microstructurally stable nickel/iron casting alloy which exhibits high strength at elevated temperatures, and which has better resistance to scale formation, similar to that of cobalt alloys, accompanied by properties which are otherwise as good as those of the abovementioned alloy according to German Pat. No. 2,714,674.

In order to achieve this object, an alloy is proposed, according to the invention, which possesses the compositions characterised in the Claims, advantageous embodiments being characterised in the sub-claims.

The alloy according to the invention differs from the known alloy according to German Pat. No. 2,714,674, in that it contains no tungsten but has an increased molybdenum content. Tungsten is comparatively more expensive, and, in addition, its availability is less reliable than that of molybdenum. In addition, the known alloy can contain no iron, or can have a maximum iron content of 59.3%, while in the case of the alloy according to the invention the iron content is, with a view to achieving the required properties, narrowly limited to 18 to 26%. The same applies to the chromium content, which must lie within the range from 22 to 26%. The chromium in the solid solution is principally responsible for the high resistance to oxidation and corrosion, while the chromium which is bonded in the carbide additionally determines the wear resistance. For reasons relating to toughness, the formation of coarse primary carbides was countered by the upper limit of the chromium content. Moreover, higher chromium contents adversely affect the welding behaviour in an unacceptable manner.

Molybdenum, in amounts of 12.5 to 14.5%, if dissolved in the solid solution, improves the strength at elevated temperatures and the corrosion resistance of the alloy according to the invention, and the molybdenum bonded in the carbide improves the wear resistance. German Pat. No. 2,714,674 contains no teaching with regard to the replacement of tungsten, an element which forms carbide and intermetallic phases, by molybdenum, which does not form absolutely identical phases, the known teaching pointing, rather, in the direction of providing a tungsten content of at least 1.5%. Moreover, it could not be foreseen that, if tungsten were missing from the alloy, the considerable improvement in the resistance to scale formation would occur, which is to be described in more detail in the text which follows. Furthermore, the knowledge on which the invention is based cannot be inferred from German Pat. No. 2,714,674, namely that careful limitation of the elements nickel, iron, chromium and molybdenum, which affect one another, prevents the catastrophic oxidation which can otherwise be frequently observed in materials having high molybdenum contents, which results from the formation of volatile oxides. It was thus impossible to foresee that not only can the same resistance to scale formation be achieved by exceeding the maximum molybdenum content, 12% specified in German Pat. No. 2,714,674, but that it is possible to achieve considerably improved resistance to scale formation.

In order to obtain good welding properties, the carbon, which is needed for carbide formation, must satisfy a minimum value, and is limited to a maximum value of 1.6%, in order to avoid the formation of coarse primary carbides, and to ensure that the hardness is adequate.

The effective carbon content is also of particular importance, this quantity being calculated in accordance with the formula $$\% C_{eff} = (\% C + 0.86) \times (\% N + 1.11) \times \% B$$

and which should preferably lie between 1.1 and 1.6.

Manganese serves as a deoxidizing and desulphurizing agent, but is limited to a maximum of 0.2% in order to prevent the formation of pores in the cast material, or in weld metal.

Silicon increase the corrosion resistance in reduced acid solutions and improves the flow-behaviour in the liquid phase.

Niobium/tantalum is added in order to refine the grain structure.

The form of the special carbides is controlled by suitable deoxidizing agents, such as calcium, magnesium, aluminium, zirconium, and rare earth metals.

Examination by metallography and X-ray techniques of the microstructure of the alloy according to the invention shows that it consists of primary dendrites possessing a cubic face-centered structure, and an eutectic which is formed from the remainder of the melt and is composed of solid solution and carbides of the $M_7C_3$ and $M_6C$ types.

FIG. 1 is a graph representing the variation of the hardness as a function of the effective carbon content of the alloy according to the invention, in the cast condition.

FIG. 2*a* is a micrograph, taken under oblique illumination, of the nickel alloy according to the invention, in the untreated condition, following etching in mixed nitric/sulphuric acid, and FIG. 2*b* is a corresponding micrograph, taken after heating the alloy, in air, for 1000 hours at 600° C.

| Alloy Number | C | Si | Cr | Mo | Ni | W | Co | Nb | Fe | V |
|---|---|---|---|---|---|---|---|---|---|---|
| (1) Alloy acc. to the inv. | 1.45 | 1.0 | 24.5 | 13 | 36 | — | — | 0.4 | 24 | — |
| (2) German Patent 2,714,674 | 1.30 | 1.35 | 24 | 8 | 35 | 4 | — | 0.45 | 25 | 1.3 |
| (3) Material No. 3177.0 | 1.0 | 1.4 | 27 | — | 1.5 | 4.5 | R | — | — | — |

The above materials were annealed in air having a dew point of 15° C. and the test duration was 100 hours.

Figure 1:
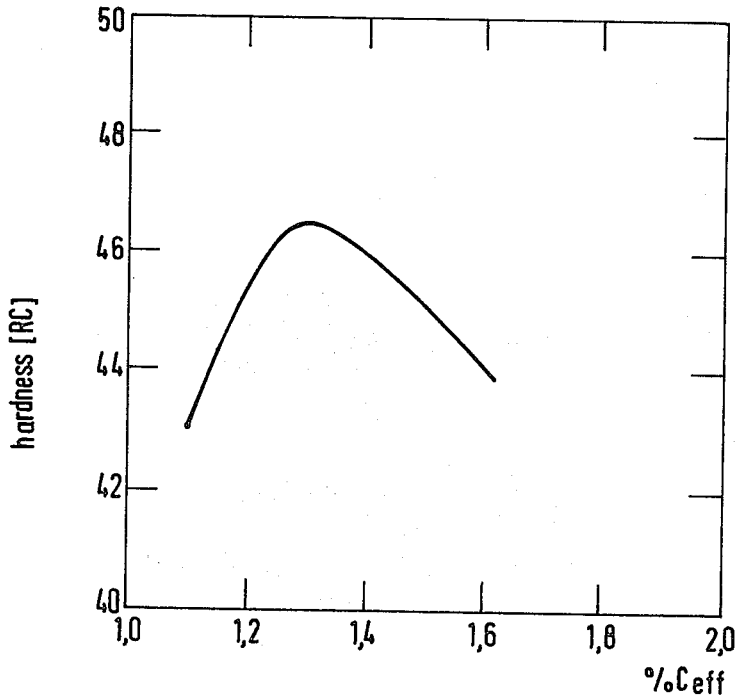

FIG. 1 shows that the hardness reaches a maximum value at an effective carbon content, $C_{eff}$, of 1.3%.

Figure 2A:
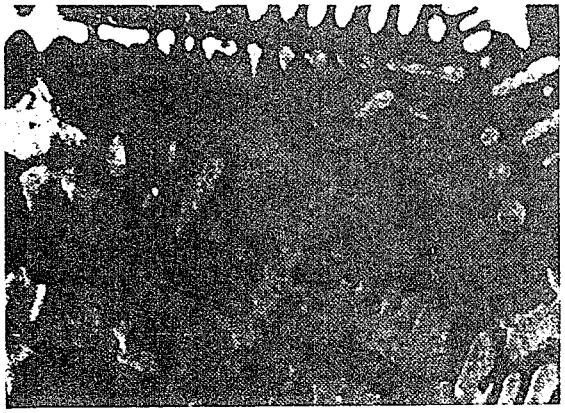
Figure 2B:
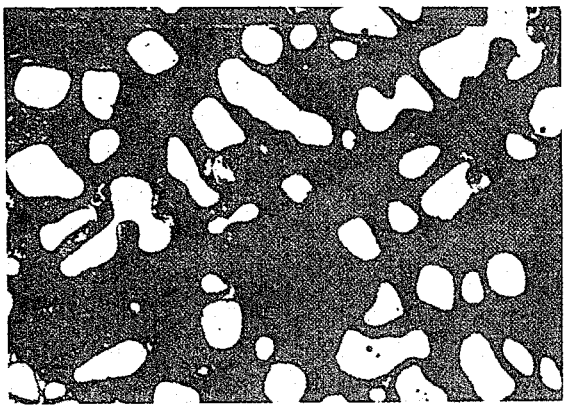

The alloy according to the invention exhibits a surprisingly high thermodynamic stability between 350 and 600° C., as confirmed by FIG. 2. FIG. 2*a* shows the microstructure at a magnification of 1000x, corresponding to the rapidly quenched cast condition, while FIG. 2*b* shows the microstructural condition following a subsequent 1000-hour annealing treatment at 600° C. No microstructural changes can be observed. The alloy, according to the invention, employed in the tests which are reproduced in FIGS. 1 to 3 had the following composition, in % by weight:

| C | Si | Cr | Mo | Ni | Nb | Fe |
|---|---|---|---|---|---|---|
| 1.45 | 1.0 | 24.5 | 13.0 | 36 | 0.4 | 24 |

Figure 3:
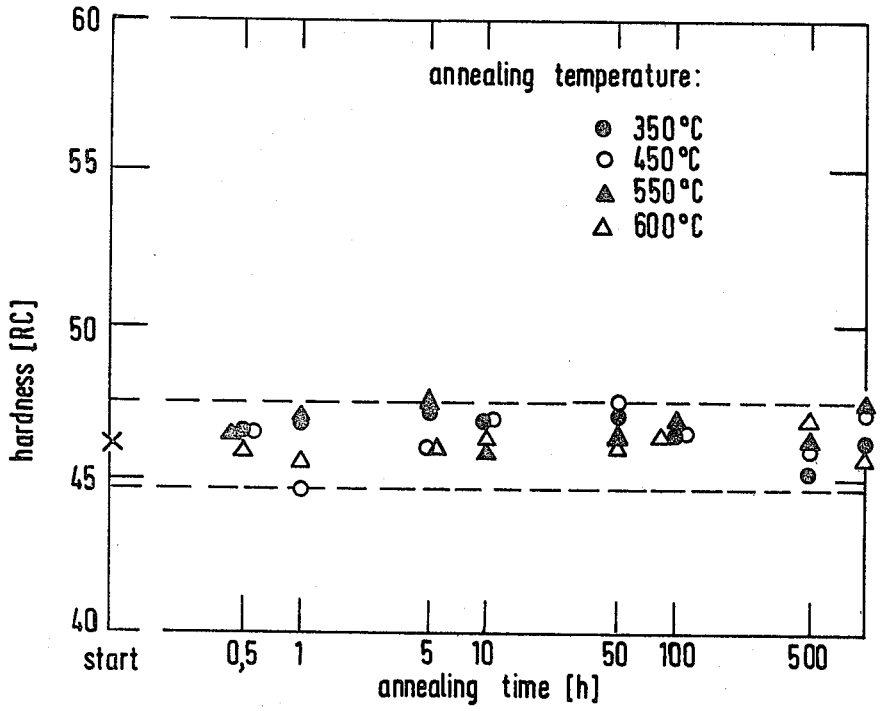
FIG. 3 is a graph on which the scatter-band of the hardness has been plotted, following annealing treatments of various durations, at temperatures within the range from 350° to 600° C.

The stability of the microstructure is confirmed by hardness measurements. Since the service temperatures in the flange region of nuclear reactors approximate to 350° C. and, under fault conditions, even rise to 500° C. for short periods, the hardness of cast material and TIG-welded material was determined after annealing treatments of progressively longer duration, at temperatures between 350° and 600° C. FIG. 3 shows the relatively narrow scatter-band of these hardnesses, with values of between 45 and 48 Rockwell C for annealing times ranging up to 1000 hours. According to these results, the hardness of the alloy according to the invention is determined by its primary microstructure. Up to 600° C. the variation in the hardness gave no indication of over-ageing processes.

In further tests, the alloy according to the invention was compared with the commercially available cobalt-based alloy, Material No. 3177.0. The materials tested had the following compositions:

| Alloying addition | Example of the alloy for which patent protection is claimed | Material No. 3177.0 |
|---|---|---|
| C | 1.45 | 1 |
| Si | 1.0 | 1.4 |
| Cr | 24.5 | 27 |
| Mo | 13 | — |
| Ni | 36 | 1.5 |
| W | — | 4.5 |
| Co | — | remainder |
| Nb | 0.4 | — |
| Fe | 24 | <2.0 |

Figure 4:
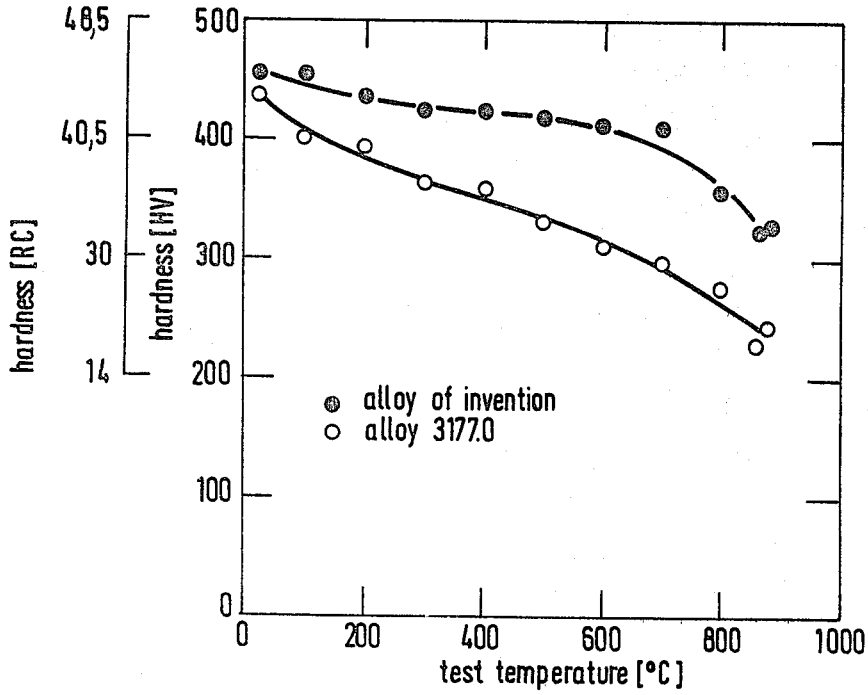
FIG. 4 shows the hot-hardness of the nickel alloy according to the invention, in the cast condition, compared to the known Material No. 3177.0.

FIG. 4 shows that, compared with the known cobalt alloy, the alloy according to the invention exhibits superior hardness at temperatures up to at least 900° C. The comparatively large resistance to deformation at elevated temperatures characterises the hot-strength of the alloy according to the invention.

Figure 5:
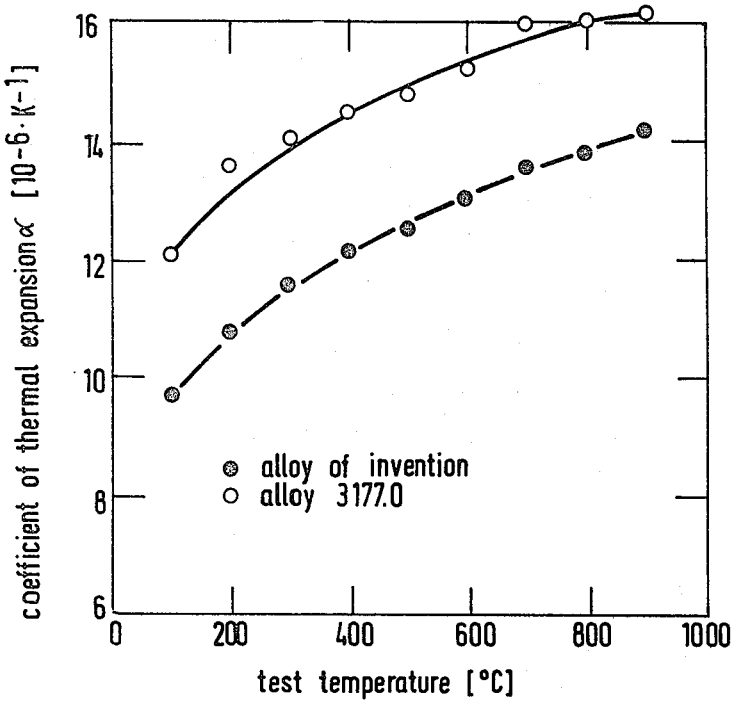
FIG. 5 shows the temperature-dependence of the mean coefficient of linear thermal expansion, and of the modulus of elasticity of the nickel alloy according to the invention, in the cast condition.
Figure 5A:
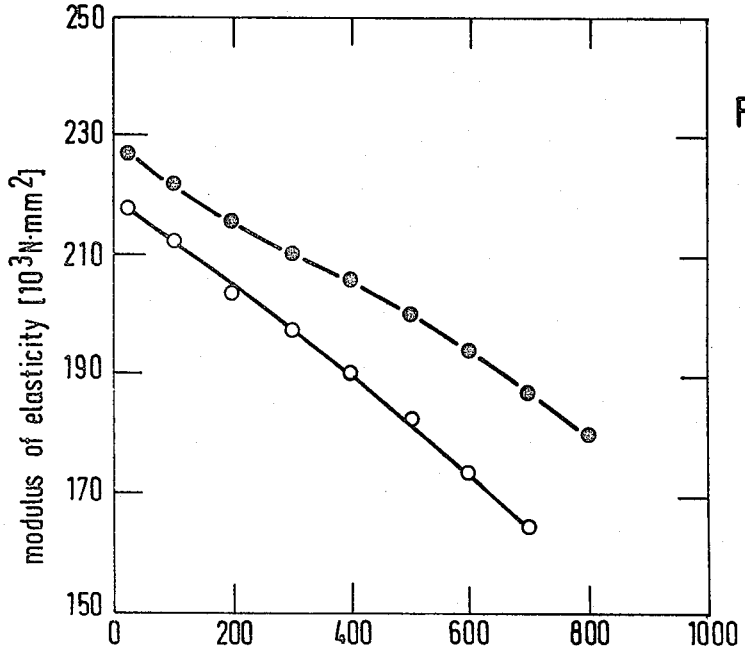

The resistance to thermal fatigue is advantageously influenced by a high modulus of elasticity and low coefficients of expansion (FIG. 5). Over the entire temperature range which was investigated, up to 900° C., the nickel alloy according to the invention possesses a lower coefficient of expansion and a higher modulus of elasticity than the known cobalt alloy which was selected for comparison.

Figure 6:
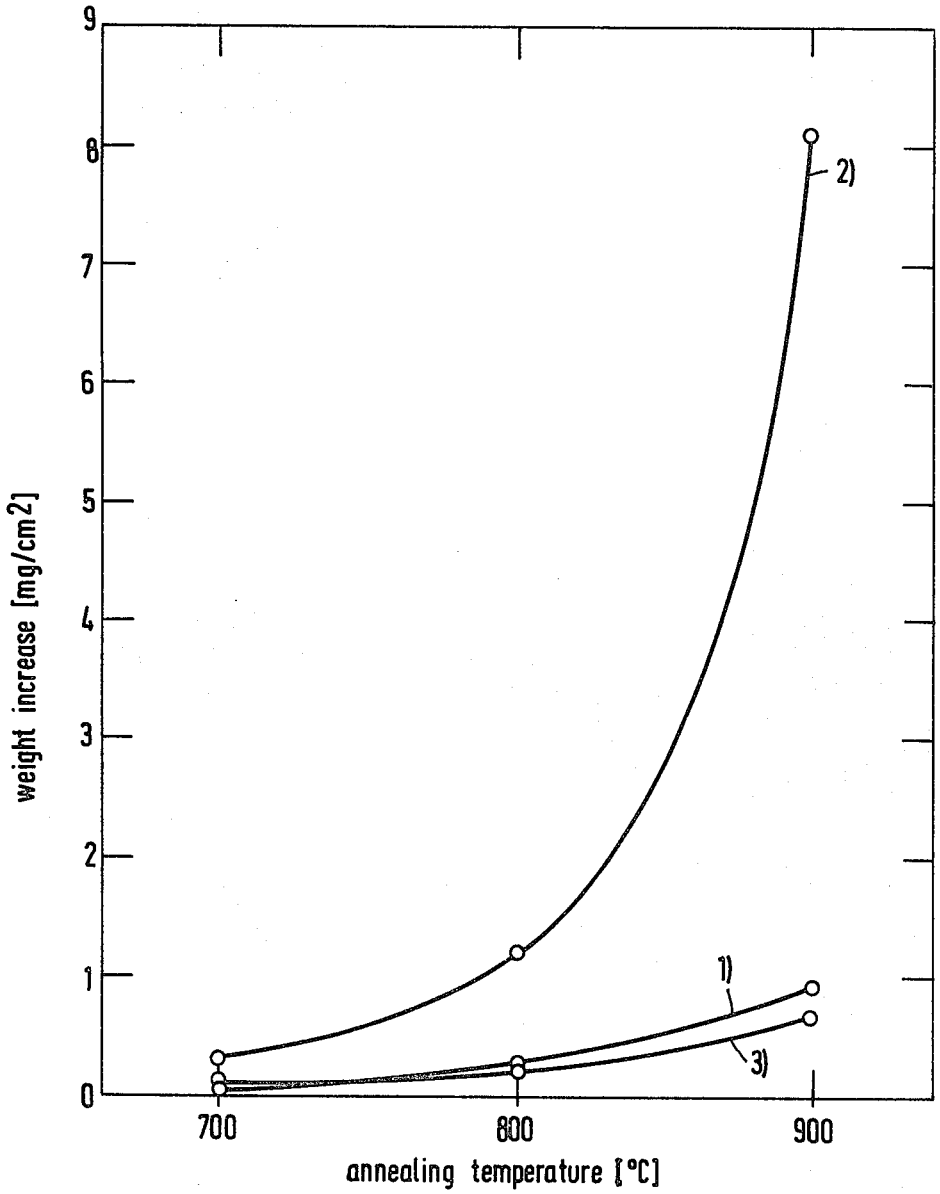
FIG. 6 illustrates the scale-formation behaviour of the nickel alloy according to the invention, compared to known alloys, the compositions of the alloys Nos. 1–3 which were tested being as follows.

As shown in FIG. 6, the nickel alloy for which patent protection is claimed is highly resistant to oxidation, that is to say to scale formation. Up to 900° C., the oxidation behaviour of the new alloy is identical to that of the cobalt alloy. In contrast to this, the commercially available alloy according to German Pat. No. 2,714,674 exhibits a tendency towards catastrophic oxidation, as is evident from the sharp increase in oxidation above 800° C.

The following Table permits a comparison of the corrosion data. The test results show that the nickel alloy according to the invention is superior to the cobalt-based comparison alloy in terms of its resistance to sulphuric acid and to hydrochloric acid.

| Material | Corrosion behaviour Samples: Cast bars, 5 mm dia. Test temperature: 50° C. Weight loss, in $gm^{-2}h^{-1}$ | |
|---|---|---|
| | 50% $H_2SO_4$ | 10% HCl |
| Ni alloy for which pat. prot is claimed | 10.99 | 0.91 |
| Matl. No. 3177.0 (Co alloy) | 62.86 | 49.04 |

Due to the combination of properties which it possesses, especially hot-hardness, corrosion resistance, and resistance to scale formation, the alloy according to the invention is particularly suitable for nuclear reactor components, and for armouring valves.

We claim:

1. Nickel/iron casting alloy, containing no cobalt, exhibiting high strength at elevated temperatures accompanied by insensitivity to thermal fatigue, possessing microstructural constituents which are thermodynamically highly stable, and exhibiting, in addition, high hardness at elevated temperatures, outstanding resistance to oxidation, corrosion and wear, as well as good welding properties, composed of 1.1 to 1.6% of carbon
0.5 to 1.5% of silicon
0.01 to 0.2% of manganese
22 to 26% of chromium
12.5 to 14.5% of molybdenum
0.2 to 0.8% of niobium (columbium)
35 to 40% of nickel
less than 0.01% of boron
less than 0.002% of tantalum and
18 to 26% of iron, to make up 100%.

2. Alloy according to claim 1, characterised by the following composition 1.25 to 1.55% of carbon
0.8 to 1.30% of silicon
0.02 to 0.15% of manganese
24 to 26% of chromium
12.5 to 13.5% of molybdenum
0.3 to 0.7% of niobium (columbium)
35 to 37.5% of nickel
less than 0.01% of boron
less than 0.002% of tantalum and
19 to 26% of iron, to make up 100%.

3. Alloy according to claim 1, with the proviso that $$1.1 < \% C_{eff} < 1.6$$

($C_{eff}$ being the effective carbon content) where $$C_{eff} = (\% C + 0.86) \times (\% N + 1.11) \times \% B.$$

4. Alloy according to claim 2, with the proviso that $$1.25 < \% C_{eff} < 1.50$$

($C_{eff}$ being the effective carbon content) where $$C_{eff} = (\% C + 0.86) \times (\% N + 1.11) \times \% B.$$

5. A nuclear reactor component made from the alloy of claim 1.

6. The component of claim 5 which is at least a portion of the flange region of the nuclear reactor.

7. An armoured valve wherein the armouring is with the alloy of claim 1.

8. An armoured hot-steam fitting wherein the armouring is with the alloy of claim 1.

9. An armoured chain saw wherein the armouring is with the alloy of claim 1.

* * * * *